United States Patent [19]

Jenis et al.

[11] 4,114,684

[45] Sep. 19, 1978

[54] TUBE SUPPORT SYSTEM FOR HEAT EXCHANGER

[75] Inventors: Donald S. Jenis, Cape Elizabeth; Thomas A. Kuczkowski, Scarborough; Jack S. Mazer, South Portland; Douglas F. Westerkamp, Cape Elizabeth, all of Me.

[73] Assignee: General Electric Company, Schenectady, N.Y.

[21] Appl. No.: 786,611

[22] Filed: Apr. 11, 1977

[51] Int. Cl.[2] ..... F28F 7/00

[52] U.S. Cl. ..... 165/82; 165/162

[58] Field of Search ..... 165/82, 162, 67, 69, 165/76

[56] References Cited

U.S. PATENT DOCUMENTS

| | | | |
|---|---|---|---|
| 3,007,679 | 11/1961 | Byerbey et al. | 165/69 X |
| 3,020,024 | 2/1962 | Lawrance | 165/82 |
| 3,199,582 | 8/1965 | Vogt et al. | 165/69 |
| 3,212,567 | 10/1965 | Romanos | 165/69 |
| 3,249,153 | 5/1966 | Holland | 165/76 |
| 3,494,414 | 2/1970 | Warner | 165/82 |
| 3,596,638 | 8/1971 | Michel | 165/82 X |
| 3,745,978 | 7/1973 | Armand | 165/78 X |
| 3,776,302 | 12/1973 | Waszink et al. | 165/82 |
| 3,776,303 | 12/1973 | Anderson et al. | 165/82 |
| 3,833,055 | 9/1974 | Mung et al. | 165/82 |
| 3,848,430 | 11/1974 | Porter et al. | 165/82 X |
| 3,896,874 | 7/1975 | Bongaards et al. | 165/82 |
| 3,967,677 | 7/1976 | Mohlman | 165/162 |

*Primary Examiner*—Charles J. Myhre
*Assistant Examiner*—Ira S. Lazarus
*Attorney, Agent, or Firm*—James W. Mitchell; John F. Ahern

[57] ABSTRACT

A support system is provided for a bundle of U-shaped tubes in a heat exchanger of the shell and tube type. The system includes a fixed frame including a plurality of support plates for the majority of the length of the bundle and a floating frame including a plurality of support plates for the U-bend end of the bundle. The floating frame is mounted on the tubes and is free to move relative to the fixed frame, thus allowing freedom of expansion of the tubes through the fixed frame support plates even on the occurrence of tube binding in the floating frame support plates adjacent the U-bend end.

16 Claims, 6 Drawing Figures

TUBE SUPPORT SYSTEM FOR HEAT EXCHANGER

BACKGROUND OF THE INVENTION

1. Field of the Invention

This invention relates to heat exchangers and, more particularly, to a tube support system for U-shaped tubes in heat exchangers of the shell and tube type.

2. Description of the Prior Art

Heat exchangers of the shell and tube type generally include a cylindrical outer shell and a bundle of inner tubes transiting the length of the shell. Commonly, each of the tubes is formed in the shape of an elongated U with the U-bend portion position at one end of the shell and the straight portions or legs terminated in a perforated tube sheet at the opposite end of the shell. The tubes are maintained in a parallel relationship and restrained against excessive vibration by perforated, tube support plates fixed, at spaced intervals along the length of the shell, to a frame assembly attached to the tube sheet. First and second fluids, between which heat is to be exchanged, are passed through the tubes and through the shell region surrounding the tubes, respectively. Isolation between the fluids is provided by confining the first fluid within the tubes and by confining the second fluid within the shell region transited by the tubes.

Construction of heat exchangers in the manner described is advantageous in that it facilitates easy removal of tube bundles for maintenance and inspection, since the tubes are only fixedly attached at one end of the shell. Such construction, however, must allow for thermal expansion of the tubes relative to the fixed support plates and also relative to each other. It is known to make the perforations in the support plates oversized to allow relative movement between the tubes and the plates, but oversizing alone has proven to be inadequate in large heat exchangers operating at high temperatures. In such heat exchangers the tubes tend to bind in the support plate closest to the U-bends and tube or support plate failure may result. This binding is caused largely by two types of tube thermal expansion. The first of these is differential longitudinal expansion of the legs of individual tubes relative to each other. This type of expansion applies not only longitudinal forces tending to lengthen the individual tubes, but also transverse forces tending to move the tube legs out of the parallel relationship maintained by the support plates. Such movement is restricted by the support plate closest to the U-bends and the tube legs bind in this plate. The second type of thermal expansion is transverse expansion of the U-bends themselves. This type of expansion applies forces transverse to the leg axes tending to increase the separation between the tube legs. Since increased separation is also restricted by the support plate closest to the U-bends, the expansion of the U-bends also causes binding in this support plate.

The present invention provides support means for a tube bundle which overcomes the aforementioned binding problem and allows both differential longitudinal expansion of tube legs and transverse expansion of U-bends, without sacrificing the vibration inhibiting effect of support plates. Support means is also provided to allow expansion of members to which the support plates are fixed, relative to the shell. Additionally, support of a tube bundle in accordance with the present invention does not require any connection of the bundle to the shell which would prevent easy removal of the bundle from the shell.

SUMMARY OF THE INVENTION

Allowing free expansion of a bundle of U-shaped tubes without sacrificing the vibration inhibiting effect of support plates is accomplished by utilizing a tube support system comprising a fixed frame and a floating frame. The fixed frame is mounted in the region of the chamber adjacent the tube sheet and extends along the majority of the length of the bundle. This frame includes a plurality of tube support plates positioned at spaced intervals along the tube legs. The support plates extend transversely of the tubes and include perforations through which the tubes pass. Expansion of the tube legs in the region occupied by the fixed frame applies no significant forces transverse to the tube axes and binding of the tubes passing through the fixed frame is averted by merely making the support plate perforations slightly oversized with respect to the tubes. Longitudinal thermal expansion of the fixed frame itself is accommodated by slidably mounting the frame on a pair of rails attached to the shell.

The floating frame also includes a plurality of spaced support plates extending transversely of the tubes and including oversized perforations through which the tubes pass. This frame, however, is mounted on the tube legs themselves along the portion of the legs adjacent the U-bends. Binding of the tubes passing through this floating frame does occur, because of the transverse forces in the U-bend end of the bundle, but this frame is free to move with the U-bend end of the bundle. Thus, no restriction is imposed on free expansion of the tubes through the fixed frame by binding of tubes in support plates adjacent the U-bends, and the vibration inhibiting effect of support plates located adjacent the U-bends is not sacrificed. Elastic suspension means may be utilized to remove part of the weight of the floating frame from the tube bundle without significantly restricting the floating frame's freedom of movement. The floating frame is free to move both linearly and rotationally to accommodate movement of the tubes at the U-bend end of the bundles.

DESCRIPTION OF THE PREFERRED EMBODIMENTS

A particular type of shell and tube heat exchanger in which the present invention finds utility is a moisture separator reheater (MSR) used in nuclear steam turbine systems. Such MSR's tend to be large and operate at high temperatures causing substantial thermal expansion of internal tubes during operation. Additionally, tube side and shell-side steam flowing through the MSR tends to cause tube vibration. This thermal expansion and vibration are known causes of failure of the tubes and support structure therefor. An MSR into which an embodiment of the tube support system of the present invention has been incorporated to prevent such failure is illustrated in FIG. 1.

Figure 1:
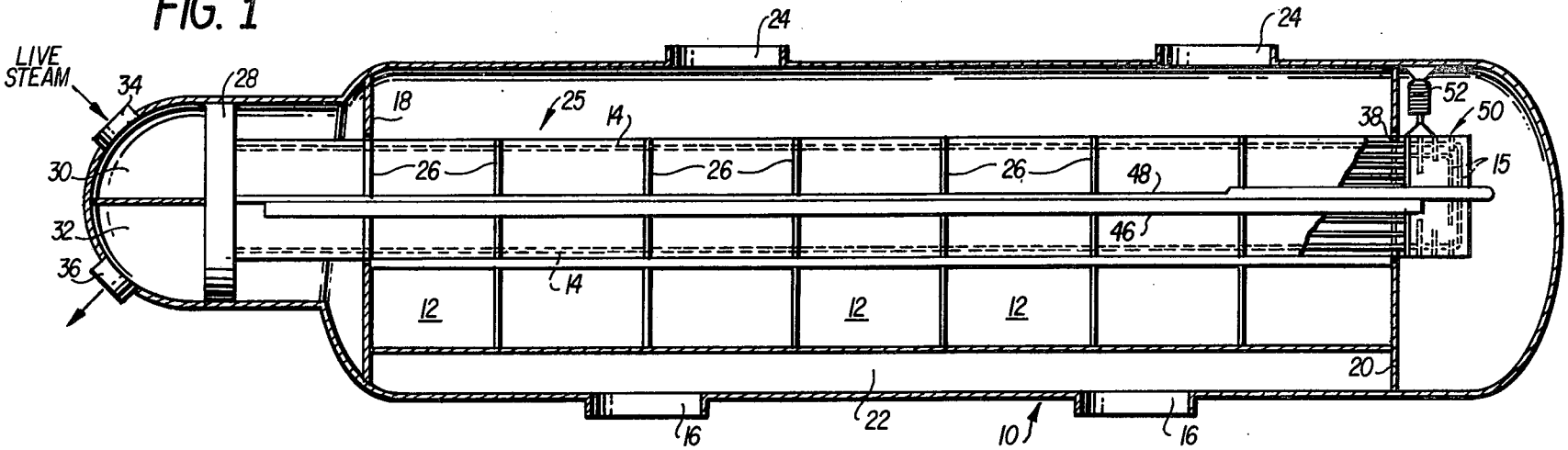
FIG. 1 illustrates a single stage moisture separator reheater including an embodiment of the tube support system of the invention.

FIG. 1 illustrates a single-stage MSR utilized to dry and reheat damp, saturated steam received from one turbine stage and to supply the steam in a superheated form to a subsequent turbine stage. Generally, the MSR comprises a horizontally elongated cylindrical shell 10 including a lower drying region containing a plurality of moisture separator panels 12 and an upper heating region transited by parallel legs 14 of a bundle of elongated U-shaped tubes. The damp, saturated steam enters shell inlet ports 16 and is distributed along the bottom of the shell between stiffening bulkheads 18 and 20 by a plenum 22. It then passes upwardly through the moisture separator panels where moisture is extracted. The steam leaves the panels in dry, saturated form and continues to flow upward through the region containing the tube bundle where heat is transferred from live steam flowing through the tubes to effect superheating of the saturated steam. The superheated steam leaves the shell at outlet ports 24.

The tube support system includes a fixed frame and a floating frame. The fixed frame, indicated generally by the numeral 25 includes a plurality of tube support plates 26 positioned at spaced intervals along the tube legs 14, each plate having perforations through which the tube legs pass. The perforations in these plates are slightly oversized to allow unrestricted expansion of the tubes with a typical ratio of diameters of perforations to tubes being 1.03 to 1.00. Frame 25 is mounted in the shell adjacent a tube sheet 28 and extends along the majority of the length of the bundle from this tube sheet to the bulkhead 20. The tube legs passing through the frame terminate in perforations in the tube sheet which seals one end of the shell and also serves as one wall of an inlet header 30 and an outlet header 32. The tube bundle is positioned in the shell so that U-bends 15 are vertically aligned and each tube has an upper leg and a lower leg. The upper legs terminate in tube sheet perforations communicating with the inlet header 30 and the lower legs terminate in tube sheet perforations communicating with the outlet header 32. Live steam flowing through the tubes enters the MSR at an inlet port 34 and then follows a course through inlet header 30, upper legs, U-bends, lower legs, outlet header 32 and finally exits at an outlet port 36.

Figure 2:
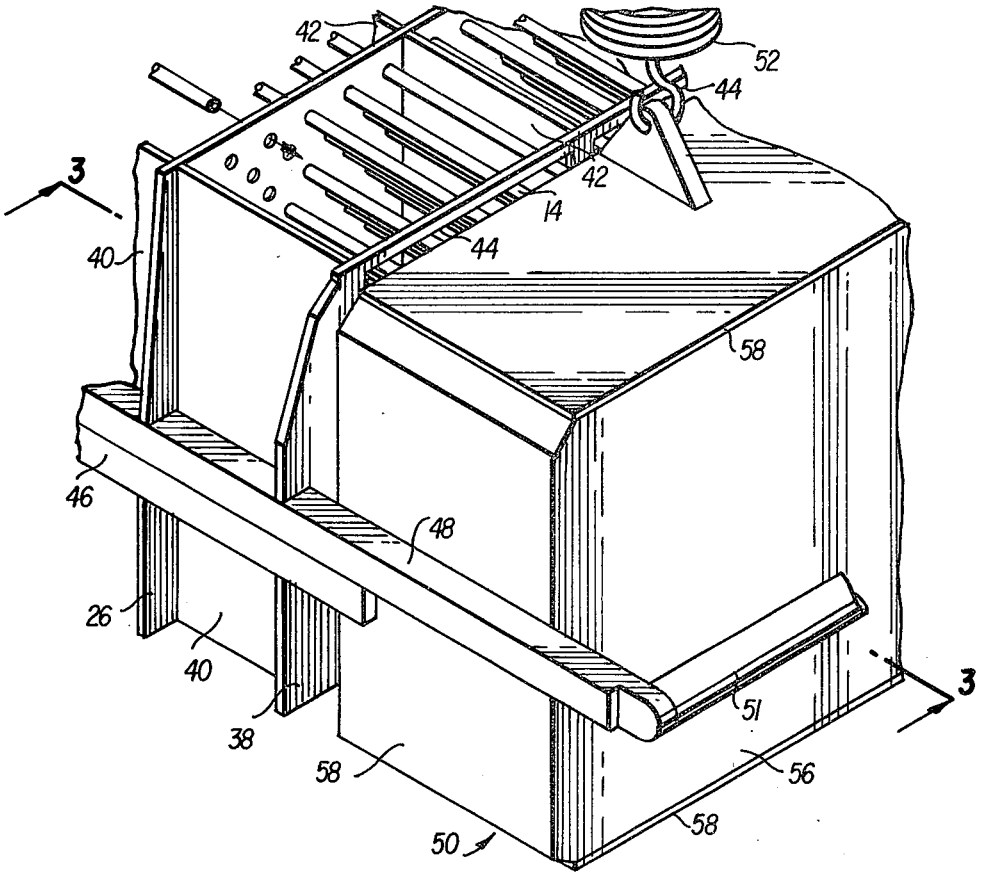
FIG. 2 is an enlarged isometric view of a portion of the tube support system in the moisture separator reheater of FIG. 1.

Construction of the fixed frame is illustrated in detail in the enlarged view of FIG. 2. In addition to the tube support plates 26, one of which is shown in FIG. 2, this frame includes a window plate 38 and a plurality of side plates 40 and center plates 42 extending between each adjacent pair of tube support plates and between the window plate 38 and the tube support plate 26 closest to it. The window plate is located at the very end of the frame and it includes two rectangular openings 44 which are large enough to allow complete freedom of movement of the tubes passing through the frame at this location. The main function of the window plate is to inhibit vibration of the center plate and side plates located at the end of the frame. The side plates and center plates serve to maintain the tube support plates in their spaced relationship and to guide the dry saturated steam leaving the moisture separator panels 12 (see FIG. 1) through the shell region containing the tube legs 14.

Mounting means for the fixed frame is provided in the form of two pairs of rails, as best illustrated in FIGS. 1 and 2. A pair of shell rails 46 are attached to opposite sides of the interior of the shell and extend along the majority of the length of the shell. A pair of bundle rails 48 are attached to opposite sides of the fixed frame and are attached at one end to the tube sheet 28. The bundle rails and thus the fixed frame 25 and tube legs 14 passing therethrough are slidably supported on the pair of shell rails 46. This type of mounting means enables removal of the tube bundle for maintenance and inspection by pulling the tube sheet and attached bundle rails out of one end of the shell. Such rail mounting means also allows free longitudinal expansion of the fixed frame relative to the shell.

Figure 3:
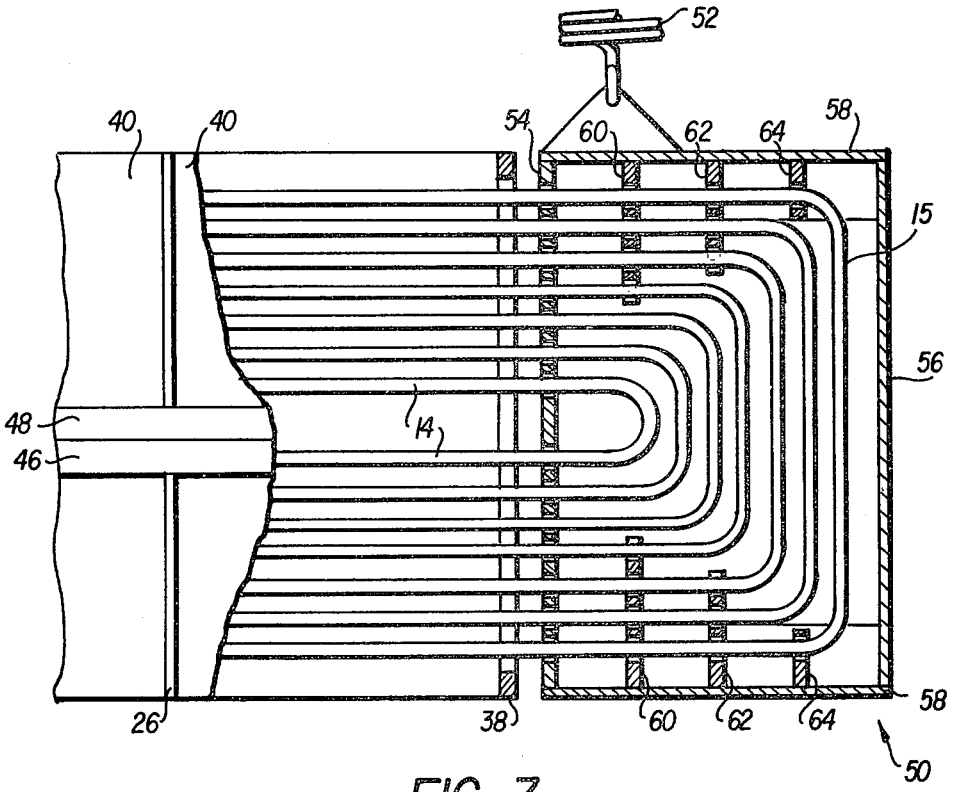
FIG. 3 is a side view of the portion of the tube support system illustrated in FIG. 2.

Mounting and construction of the floating frame portion of the tube support system can best be understood by referring to FIGS. 1, 2 and 3. This floating frame, indicated generally by the numeral 50, is mounted on the tube legs 14 adjacent the U-bends 15 and is free to move relative to the fixed frame 25. It is positioned between the bundle rails 48 which extend along both sides thereof and terminate at a spacer rod 51. This rod maintains adequate separation between the rails so that sides of the floating frame are not normally in contact with the rails. These bundles rails do, however, limit horizontal movement of the frame. Where the floating frame is large, which is frequently the case in single-step MSR's, the frame is preferably additionally supported by elastic suspension means. In the particular MSR shown in FIGS. 1, 2 and 3, a coil spring 52 is connected between the floating frame and an inner surface of the shell to provide this additional support.

The floating frame comprises an enclosure including a full tube support plate 54 extending completely across the bundle and an end plate 56. Spacing members 58, in the shape of flat sheets extend transversely of plates 54 and 56 and are attached to edges thereof to complete the enclosure. The spacing members are also attached to edges of a plurality of pairs of partial tube support plates 60, 62 and 64 and these members maintain plate 54 and plate pairs 60, 62 and 64 in a spaced relationship. The partial tube support plates are positioned closer to the U-bends 15 than the full tube support plate 54, and they extend only part way across the bundle. All of the tube support plates in the floating frame have oversized perforations through which tube legs pass.

It is to be noted that the partial tube support plates extend progressively lesser distances across the tube bundle as their distance from full tube support plate 54 increases. The reason for this variation in size becomes evident when it is noted that the U-tubes extend progressively further into the floating support as their distance from the center of the bundle increases. Tubes near the the center of the bundle extend only a short distance beyond plate 54 and no further support is required. Tubes at increasing distances away from the center of the bundle extend progressively further into the floating support, however, and require progressively more support plates to ensure that their unsupported length does not become excessive. Such excessive, unsupported length could result in destructive vibration of the U-bends. The use of the partial tube support plates to limit unsupported length not only inhibits tube vibration, but also acts to distribute the weight of the floating support resting on the tubes.

The manner in which the tube support system of the present invention accommodates thermal expansion of the tubes without sacrificing vibration inhibiting effectiveness will now be explained. During startup and operation of the MSR the high temperatures existing therein cause thermal expansion of the tubes and the tube support system. Diametric expansion of the tubes is insignificant in view of the relatively small diameter of the tubes (typically one inch) and the provision of oversized perforations in the tube support plates. Because of the great length of the tube bundles in large MSR's, however, longitudinal expansion of the tubes and the fixed frame is substantial and must be provided for. The tube legs undergo greater longitudinal expansion than the support system since the steam flowing through the tubes is at a higher temperature than the steam filling the inside of the shell, and thus the tubes are at a higher temperature than the support system. In some cases this greater expansion can also be attributed to a higher coefficient of expansion of the tubes. Also, the tube legs themselves undergo differing amounts of longitudinal expansion because of a variation in temperature across the tube bundle. Since the steam rising from the moisture separator panels 12 and first contacting the lower legs of the tube bundle is cooler and increases in temperature as it flows upwardly over the tube bundle, the upper legs increase in length more than the lower legs. These differing amounts of expansion of the tubes legs and of the fixed frame relative to each other and to the shell are easily accommodated since all such expansion is longitudinal and longitudinal movement of the tubes and fixed frame is unrestricted. The tube legs lengthen freely by virtue of the oversized perforations in the tube support plates of the fixed frame. The fixed frame and bundle rails lengthen freely by virtue of their slidable support on the shell rails.

Movement of the U-bend end of the tube bundle is more complex than the movement of the fixed frame and tubes passing therethrough, however, and this complex movement must be accommodated by the support system without sacrificing vibration inhibiting support of the U-bends. Movement of the U-bends resulting from thermal expansion can be attributed to two causes: differential longitudinal expansion of the tube legs relative to each other and transverse expansion of the U-bends themselves. Although differential expansion of the tube legs causes only longitudinal tube movement in the fixed frame, the greater increase in length of the upper legs with respect to the lower legs causes the U-bend end of the bundle to bow downwardly, or droop. In prior art arrangements one or more fixed tube support plates (such as support plates 26) are typically positioned at the U-bend end of the bundle to support the tubes in this end against vibration. In such arrangements the natural tendency of the U-bend end to droop is prevented by these fixed support plates and the tubes in this end bind in the perforations of these support plates. This binding prevents further expansion of the tube legs through other support plates positioned along the length of the bundle resulting in buckling and breakage of tubes and support plates. Alternatively, if the prior art attempted to avoiding binding of the tubes by omitting support plates in the U-bend end, tube side and shell side steam flowing through and around the tubes might apply sufficient vibrational forces to the unsupported tubes to cause failure thereof. Such damage could lead to plant shutdown and expensive maintenance procedures.

In the present tube support system, droop of the U-bend end of the bundle is easily accommodated by the floating frame which is free to move with the U-bends. During start-up and operation of the MSR this frame rotates in a clockwise direction (as viewed in FIG. 1) to accommodate the greater increases in length of the upper tubes and to allow the U-bends to droop. The frame also moves downwardly to accommodate the droop. During shut-down, the floating frame rotates in a counterclockwise direction and moves upwardly as the tubes contract to their original length. No restriction is imposed on longitudinal expansion of the tube legs through the support plates of the fixed frame, even on the occurrence of tube binding in the support plates of the floating frame, because of the freedom of movement of the latter plates relative to the former. As previously mentioned, the second type of movement of the U-bend end of the tube bundle that must be accommodated by the support system is caused by expansion of the U-bends themselves. Since the U-bends extend substantially transversely between the upper and lower legs, lengthening of the U-bends resulting from thermal expansion thereof tends to increase the distance between the upper and lower legs. As this distance increases, the legs are forced against the edges of perforations in tube support plates adjacent the U-bends and the legs bind in these plates. In prior art arrangements having fixed support plates adjacent the U-bends this binding prevents further expansion of the tube legs through other support plates positioned along the length of the bundle and the same buckling and breakage of tubes and support plates resulting from binding caused by droop of the U-bend end occurs. In the present tube system, the effects of binding caused by transverse expansion of the U-bends are confined to the floating frame, since all tube support plates located adjacent the U-bends are positioned therein. Again, because of the freedom of movement of these plates relative to the support plates in the fixed frame, no restriction is imposed on longitudinal expansion of the tube legs through the fixed frame.

Figure 4:
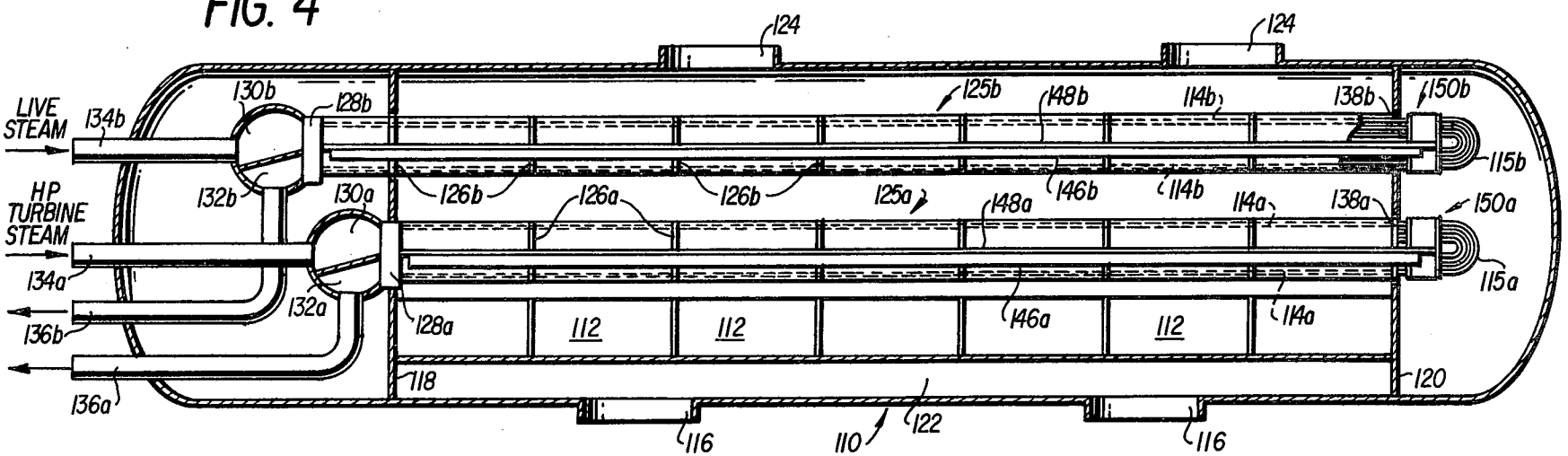
FIG. 4 illustrates a two-stage moisture separator reheater including another embodiment of the tube support system of the invention.

FIG. 4 illustrates a two-stage MSR in which another embodiment of the tube support system of the present invention has been incorporated. The two-stage MSR is similar to the single step MSR but the dried saturated steam passes through two stages of reheat. The two-stage MSR comprises a horizontally elongated, cylindrical shell 110 including a lower drying region containing a plurality of moisture separator panels 112 and an upper heating region transited by parallel legs **114*a* and 114*b* of two bundles of elongated U-shaped tubes. The damp saturated steam enters shell inlet ports 116 and is distributed along the bottom of the shell between stiffening bulkheads 118 and 120 by a plenum 122. It then passes upward through the moisture separator panels and through the two stages of reheat provided by the tube bundles 114*a* and 114*b*, respectively. Heating steam flowing through the tubes of bundle 114*b* is live steam, as in the case of the single stage MSR, but the heating steam flowing through the tubes of bundle 114*a* is bled from a high pressure turbine. Superheated steam leaves the shell at outlet ports 124**.

A separate tube support system, including a fixed frame and a floating frame, is provided for each of the two tube bundles **114*a* and 114*b*. The fixed frames of these systems, indicated generally by the numerals 125*a*** and 125b, are similar to the fixed frames of the single stage MSR and include a plurality of tube support plates 126a, 126b positioned at spaced intervals along the tube legs 114a, 114b. The tube legs of the bundles pass through oversized perforations in these plates and terminate in perforations of respective tube sheets 128a and 128b located at one end of the shell. Each tube sheet serves as one wall of an adjacent inlet header 130a, 130b and outlet header 132a, 132b. High pressure turbine steam flowing through the tubes of bundle 114a enters the MSR at an inlet port 134a and then follows a course through inlet header 130a, upper legs of the tube bundle, U-bends, lower legs, outlet header 132a and finally exits at an outlet port 136a. Live steam flowing through the tubes of bundle 114b enters the MSR at an inlet port 134b and then follows a similar course through the tubes of this bundle and exits at an outlet port 136b.

Figure 5:
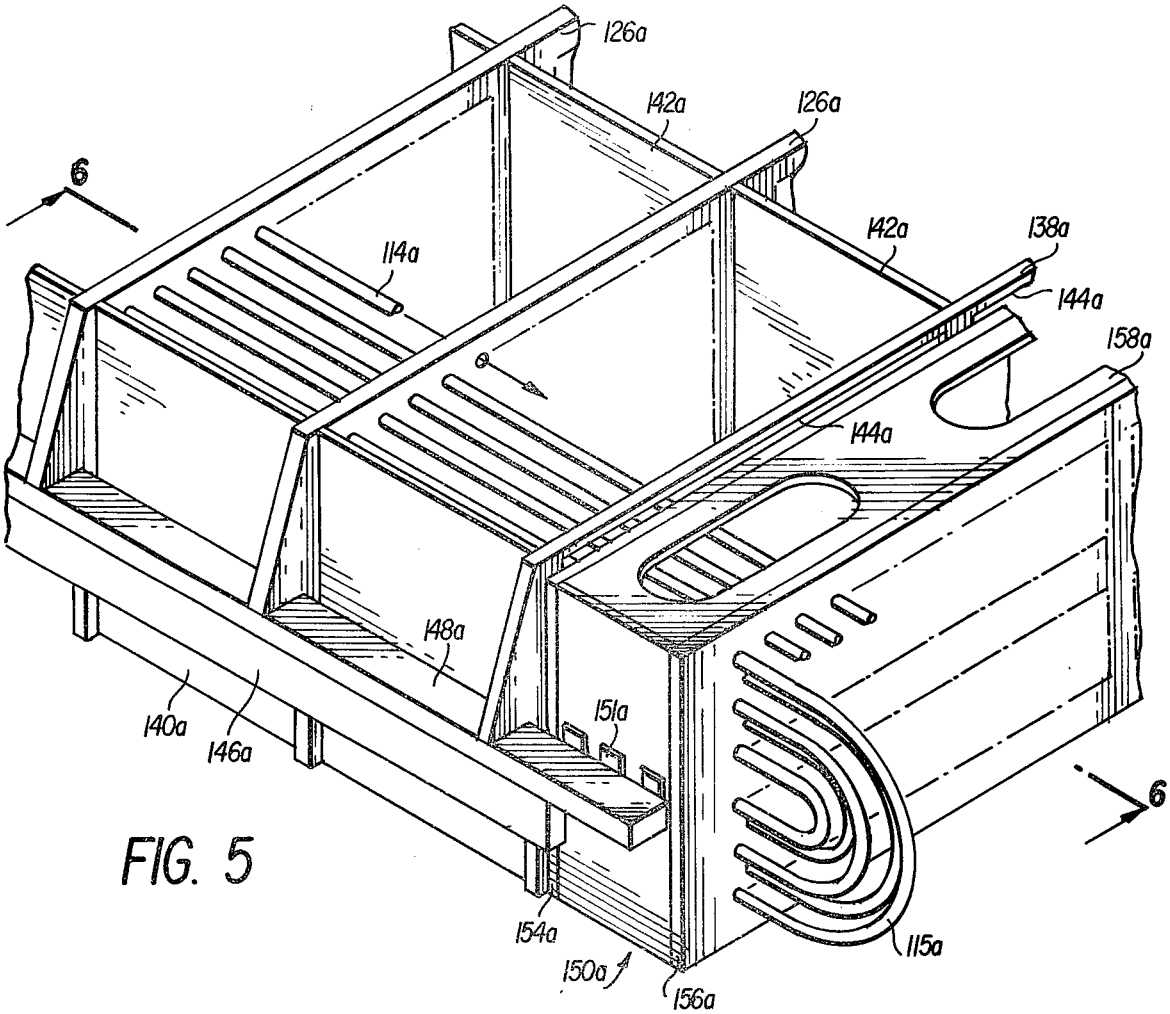
FIG. 5 is an enlarged isometric view of a portion of the tube support system in the moisture separator reheater of FIG. 4.

Construction of fixed frame 125a is illustrated in detail in the enlarged view of FIG. 5. Fixed frame 125b is essentially identical, except for overall length and both FIG. 5 and the following description are equally applicable thereto. Frame 125a includes a window plate 138a and a plurality of side plates 140a and center plates 142a extending between each adjacent pair of tube support plates and between the window plate 138a and the tube support plate 126a closest to it. The window plate is located at the end of the frame adjacent bulkhead 120 and it includes two rectangular openings 144a which are large enough to allow complete freedom of movement of the tubes passing through the frame at this location. The side plates, center plates and window plate perform the same functions as corresponding plates in the previously described single-stage MSR.

Mounting means for the fixed frame is provided in the form of two pairs of rails, as best illustrated in FIGS. 4 and 5. A pair of shell rails 146a are attached to opposite sides of the interior of the shell and extend along the majority of the length of the shell. A pair of bundle rails 148a are attached to opposite sides of the fixed frame and are also attached at one end to tube sheet 128a. The bundle rails and thus the fixed frame 125a and tube legs 114a passing therethrough are slidably supported on the pair of shell rails 146a in the same manner and for the same purpose as corresponding elements of the support system of the single-stage MSR.

Figure 6:
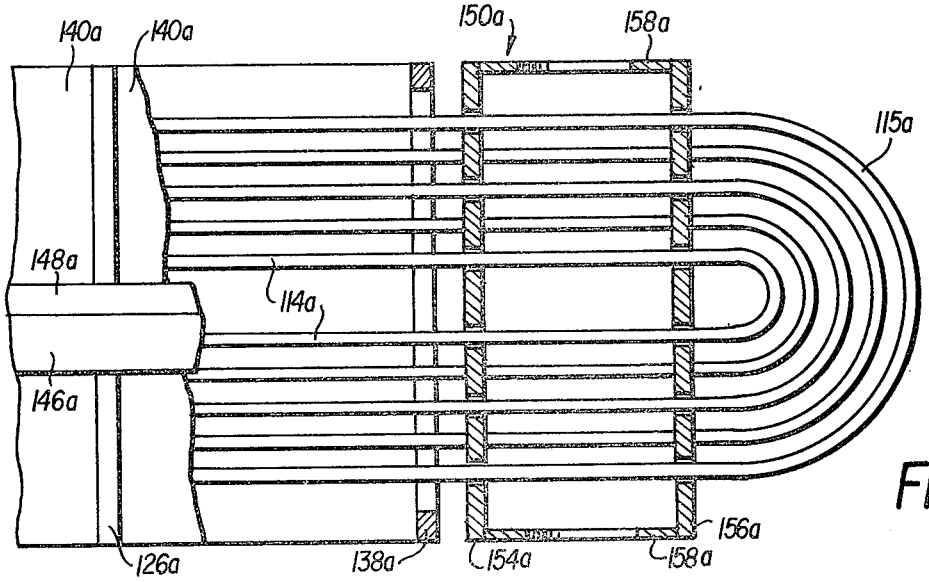
FIG. 6 is a side view of the portion of the tube support system illustrated in FIG. 5.

Mounting and construction of the floating frames 150a, 150b of the tube support systems can best be understood by referring to FIGS. 4, 5 and 6 together. The only floating frame illustrated in FIGS. 5 and 6 is the frame designated 150a and only this frame will be described. Frame 150b is essentially identical, however, and both the drawing figures and the following description are equally applicable thereto. Floating frame 150a is mounted on tube legs 114a adjacent U-bends 115a and is free to move relative to the fixed frame 125a. It is positioned between the bundle rails 148a which extend along both sides thereof. These rails rub against wear pads 151a and limit horizontal movement of the floating frame.

The floating frame comprises an enclosure including two full tube support plates 154a and 156a extending completely across the bundle, and spacing members 158a. The spacing members extend transversely of the support plates and are attached to edges thereof to maintain the plates in a spaced relationship. The support plates 154a and 156a include oversized perforations through which all tube legs 114a pass. No partial support plates are needed in frame 150a since the vertical span of the tube bundle is small compared to the span of the bundle in the single-stage MSR previously described.

During operation of the two-stage MSR, the tubes and tube support system undergo the same types of thermal expansion as occur in the single-stage MSR. Again, the tube legs undergo greater longitudinal expansion than their support systems and the upper tube legs in each bundle experience a greater increase in length than the lower legs causing the U-bend ends of the tube bundles to droop. Again, the U-bends in each bundle expand transversely between the tube legs causing the legs to bind in support plates in the floating frames. All tube movement caused by these various types of expansion is accommodated in the same manner as in the single-stage MSR, since the tubes are supported substantially in the same manner as in the single-stage MSR. The spring suspension employed in the single-stage MSR has been omitted, however, since the floating frames of the two-stage MSR are smaller and lighter than the corresponding frame in the single-stage MSR.

Thus, a tube support system constructed in accordance with the present invention provides effective support for U-shaped tubes within a heat exchanger of the shell and tube type without restricting thermal expansion of the tubes. By using two separate frames for two different parts of a tube bundle, the system supports the full length of the tube bundle against vibration while freely allowing different types of tube movement to occur in these different parts of the bundle.

Although specific embodiments of tube support systems utilized in moisture separator reheaters have been described, it is not intended that the support system of the present invention be limited to these embodiments. Rather, the support system may be utilized with any shell and tube type heat exchanger having U-shaped tubes and is subject only to the limitations imposed by the appended claims. It is also to be understood that the term U-shaped tubes, as used herein, applies to any tube formed into the general configuration of the letter U, and the invention is not limited to use with tubes having the particular shapes of the disclosed embodiments.

We claim:

1. In a heat exchange apparatus including a cylindrical shell, a perforated tube sheet located within one end of the shell, and a bundle of elongated, U-shaped tubes transiting the length of the interior of the shell, said tubes having legs terminating in the perforations of the tube sheet and having U-bends located in the opposite end of the shell, a tube support system comprising:

(a) a fixed frame mounted in the shell adjacent the tube sheet and extending along the majority of the length of the bundle, said frame including a plurality of tube support plates positioned at spaced intervals along the tube legs, said plates having oversized perforations through which the tube legs pass; and (b) a floating frame mounted on the tube legs adjacent the U-bends and free to move relative to the fixed frame, said floating frame including a plurality of spaced tube support plates having oversized perforations through which the tube legs pass.

2. A tube support system as in claim 1, and further including:

(a) a pair of shell rails attached to opposite sides of the interior of the shell; and (b) a pair of bundle rails attached to opposite sides of the fixed frame, said bundle rails slidably supported on the shell rails.

3. A tube support system as in claim 1, where the floating frame is free to move both linearly and rotationally relative to the fixed frame.

4. A tube support system as in claim 1, and further including elastic suspension means connected between the floating frame and the shell.

5. A tube support system as in claim 4, where the elastic suspension means is a coil spring.

6. A tube support system as in claim 1, where the floating frame comprises:

(a) spacing members located external to the tube bundle;

(b) a full tube support plate extending completely across the tube bundle and having edges attached to the spacing members; and (c) a plurality of partial tube support plates positioned closer to the U-bends than the full tube support plate and extending only part way across the tube bundle, said partial tube support plates attached to the spacing members.

7. A tube support system as in claim 6, where the partial tube support plates extend progressively lesser distances across the tube bundle as their distance from the full tube support plate increases.

8. A tube support system as in claim 1, where the floating frame comprises:

(a) spacing members located external to the tube bundle; and (b) a plurality of full tube support plates extending completely across the tube bundle and having edges attached to the spacing members.

9. In a moisture separator reheater including a cylindrical shell; a perforated tube sheet located within one end of the shell; and a bundle of elongated, U-shaped tubes transiting the length of the interior of the shell, said tubes having legs terminating in the perforations of the tube sheet and having U-bends located in the opposite end of the shell; a tube support system comprising:

(a) a fixed frame mounted in the shell adjacent the tube sheet and extending along the majority of the length of the bundle, said frame including a plurality of tube support plate positioned at spaced intervals along the length of the tube legs, said plates having oversized perforations through which the tube legs pass; and (b) a floating frame mounted on the tube legs adjacent the U-bends and free to move relative to the fixed frame, said floating frame including a plurality of spaced tube support plates having oversized perforations through which the tube legs pass.

10. A tube support system as in claim 9, and further including:

(a) a pair of shell rails attached to opposite sides of the interior of the shell; and (b) a pair of bundle rails attached to opposite sides of the fixed frame, said bundle rails slidably supported on the shell rails.

11. A tube support system as in claim 9, where the floating frame is free to move both linearly and rotationally relative to the fixed frame.

12. A tube support system as in claim 9, and further including elastic suspension means connected between the floating frame and the shell.

13. A tube support system as in claim 12, where the elastic suspension means is a coil spring.

14. A tube support system as in claim 9, where the floating frame comprises:

(a) spacing members located external to the tube bundle;

(b) a full tube support plate extending completely across the tube bundle and having edges attached to the spacing members; and (c) a plurality of partial tube support plates positioned closer to the U-bends than the full tube support plate and extending only part way across the tube bundle, said partial tube support plates attached to the spacing members.

15. A tube support system as in claim 14, where the partial tube support plates extend progressively lesser distances across the tube bundle as their distance from the full tube support plate increases.

16. A tube support system as in claim 9, where the floating frame comprises:

(a) spacing members located external to the tube bundle; and (b) a plurality of full tube support plates extending completely across the tube bundle and having edges attached to the spacing members.

* * * * *